United States Patent [19]

Morris

[11] Patent Number: 4,724,913

[45] Date of Patent: Feb. 16, 1988

[54] DRILL BIT AND IMPROVED CUTTING ELEMENT

[75] Inventor: Wilford V. Morris, Houston, Tex.

[73] Assignee: Strata Bit Corporation, Houston, Tex.

[21] Appl. No.: 468,037

[22] Filed: Feb. 18, 1983

[51] Int. Cl.[4] ..... E21B 10/46

[52] U.S. Cl. ..... 175/329; 175/410

[58] Field of Search ..... 175/329, 336, 373, 374, 175/410

[56] References Cited

U.S. PATENT DOCUMENTS

| | | | |
|---|---|---|---|
| 4,073,354 | 2/1978 | Rowley et al. . | |
| 4,098,363 | 7/1978 | Rohde et al. . | |
| 4,108,260 | 8/1978 | Bozarth | 175/374 |
| 4,156,329 | 5/1979 | Daniels et al. . | |
| 4,253,533 | 3/1981 | Baker, III | 175/329 |
| 4,359,112 | 11/1982 | Garner et al. | 175/336 |
| 4,359,335 | 11/1982 | Garner | 175/410 |

FOREIGN PATENT DOCUMENTS

| | | | |
|---|---|---|---|
| 0316834 | 12/1971 | U.S.S.R. | 175/410 |

*Primary Examiner*—Stephen J. Novosad
*Assistant Examiner*—William P. Neuder
*Attorney, Agent, or Firm*—Burns, Doane, Swecker & Mathis

[57] ABSTRACT

A drill bit for connection on a drill string has a hollow tubular body with an end cutting face and an exterior peripheral stabilizer surface with cylindrical sintered carbide inserts positioned therein having polycrystalline diamond cutting elements mounted on said inserts. The diamond cutting elements have a novel cutting shape facilitating drilling through hard formations with a minimum of applied weight on the bit. The cutting elements are in the shape of a relatively large disc shaped cutter commonly used for medium and soft formations but have the sides shaped into a cutting edge of substantially smaller radius. The cutting element has the strength and resistance to breakdown of the larger disc but the cutting capacity in hard formations of a smaller diameter cutter. The cutting elements are also disclosed as novel components of the drill.

11 Claims, 8 Drawing Figures

DRILL BIT AND IMPROVED CUTTING ELEMENT

BACKGROUND OF THE INVENTION

1. Field of the Invention

This invention relates to new and useful improvements in drill bits and more particularly to drill bits having improved diamond cutting elements and to the improved cutting elements, per se.

2. Brief Description of the Prior Art

Rotary drill bits used in earth drilling are primarily of two major types. One major type of drill bit is the roller cone bit having three legs depending from a bit body which support three roller cones carrying tungsten carbide teeth for cutting rock and other earth formations. Another major type of rotary drill bit is the diamond bit which has fixed teeth of industrial diamonds supported on the drill body or on metallic or carbide studs or slugs anchored in the drill body.

There are several types of diamond bits known to the drilling industry. In one type, the diamonds are a very small size and randomly distributed in a supporting matrix. Another type contains diamonds of a larger size positioned on the surface of a drill shank in a predetermined pattern. Still another type involves the use of a cutter formed of a polycrystalline diamond supported on a sintered carbide support.

Some of the most recent publications or patents dealing with diamond bits of advanced design, relevant to this invention are Rowley, et al. U.S. Pat. No. 4,073,354 and Rohde, et al. U.S. Pat. No. 4,098,363. An example of cutting inserts using polycrystalline diamond cutters and an illustration of a drill bit using such cutters, is found in Daniels, et al. U.S. Pat. No. 4,156,329.

The most comprehensive treatment of this subject in the literature is probably the chapter entitled STRATAPAX bits, pages 541–591 in ADVANCED DRILLING TECHNIQUES, by William C. Maurer, The Petroleum Publishing Company, 1421 South Sheridan Road, P. O. Box 1260, Tulsa, Okla. 74101, published in 1980. This reference illustrates and discusses in detail the development of the STRATAPAX diamond cutting elements by General Electric and gives several examples of commercial drill bits and prototypes using such cutting elements.

Commercially available diamond cutters consist of disc shaped polycrystalline diamond brazed on a cylindrical stud of tungsten carbide. There are two types generally in use. One is a relatively large diameter cutting disc which is used in soft and medium formations and to some extent in hard formations. Another type has a relatively small diameter cutting disc which is used in hard and very hard formations. The disadvantage of the small cutters is that they are secured to the supporting carbide stud on a relatively small surface area with the result that these cutters undergo much higher shear forces when cutting hard formations. In addition, the small cutters are not very effective when used in softer formations.

These patents and the cited literature show the construction of various diamond bits and related prior art but do not consider the problem of providing adequate bonding of small cutting elements to their supporting studs.

SUMMARY OF THE INVENTION

One of the objects of this invention is to provide a new and improved drill bit having diamond insert cutters having a shape providing better cutting action in hard formations without loss in cutting efficiency in softer formations.

Another object of this invention is to provide a new and improved drill bit having diamond insert cutters having a shape providing superior cutting action in hard formations and having a superior bond to the supporting cutter stud.

Another object is to provide a drill bit having carbide inserts with diamond cutting elements having a shape providing a superior cutting or penetration rate than conventional cutters for the same applied weight in drilling operation.

Still another object of this invention is to provide a drill bit having cylindrical carbide inserts with disc shaped diamond cutting elements secured thereon wherein the cutting discs are of a relatively large diameter but have a smaller cutting surface for that portion of the cutter which penetrated the formation.

Another object of this invention is to provide a new and improved diamond insert cutter for drill bits having a shape providing better cutting action in hard formations without loss in cutting efficiency in softer formations.

Another object of this invention is to provide a new and improved diamond insert cutter for drill bits having a shape providing superior cutting action in hard formations and having a superior bond to the supporting cutter stud.

Another object is to provide a carbide insert with diamond cutting element for drill bits having a shape providing a superior cutting or penetration rate than conventional cutters for the same applied weight in drilling operation.

Another object of the invention is to provide diamond cutting elements for drill bits with a shape that tends to remain sharp in service.

Still another object of this invention is to provide a cylindrical carbide drill bit insert with disc shaped diamond cutting elements secured thereon wherein the cutting discs are of a relatively large diameter but have a smaller cutting surface for that portion of the cutter which penetrated the formation.

Other objects and features of this invention will become apparent from time to time throughout the specification and claims as hereinafter related.

The foregoing objectives are accomplished by a new and improved drill bit as described herein. An improved drill bit for connection on a drill string has a hollow tubular body with an end cutting face and an exterior peripheral stabilizer surface with cylindrical sintered carbide inserts positioned therein having polycrystalline diamond cutting elements mounted on said inserts. The diamond cutting elements have a novel cutting shape facilitating drilling through hard formations with a minimum of breakage. The cutting elements are in the shape of a relatively large disc shaped cutter commonly used for medium and soft formations but have one side cut into a cutting edge of substantially smaller radius. The cutting element has the strength and resistance to breakage of the larger disc but the cutting capacity in hard formations of a smaller diameter cutter. The cutting elements are also disclosed as novel components of the drill.

DESCRIPTION OF THE PREFERRED EMBODIMENTS

Figure 1:
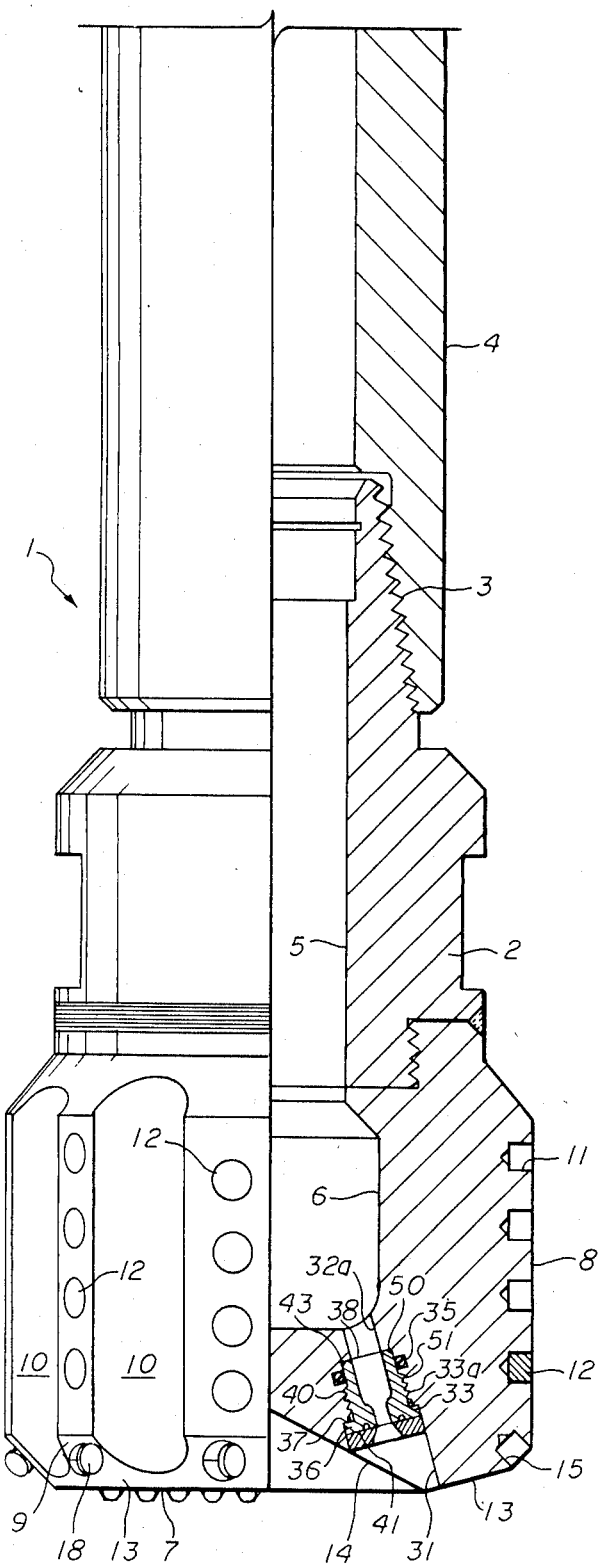
FIG. 1 is a view partly in elevation and partly in quarter section of an earth boring drill bit with diamond-containing cutting inserts incorporating a preferred embodiment of this invention.

In the following description, unless otherwise noted, the general description of the drill bit is that of the assignee's prior pending applications, viz., Radtke, U.S. Ser. No. 220,306, filed Dec. 29, 1980 and now abandoned; Ser. No. 158,389 issued Apr. 6, 1982 as Dennis U.S. Pat. No. 4,323,130; Ser. No. 296,811, issued May 3, 1983 as Radtke U.S. Pat. No. 4,381,825; Ser. No. 303,721 issued Aug. 2, 1983 as Radtke U.S. Pat. No. 4,396,077; and Ser. No. 303,960 issued Apr. 17, 1984 as Radtke U.S. Pat. No. 4,442,909.

Referring to the drawings, there is shown a drill bit 1 having improved cutting elements comprising a preferred embodiment of this invention. The drill bit also has replaceable drilling nozzles held in place by a threaded arrangement which has proven advantageous in previous drill bit designs manufactured by the assignee of this invention. The threaded arrangement for securing nozzles may be used in other types of drill bits but is particularly useful in this bit because of the close proximity of the nozzles to the cutting surface of the bit and the bottom of the drill hole which results in a very high rate of wear.

Many features in the drill bit are described in above-mentioned above-mentioned Dennis U.S. Pat. No. 4,323,130; and abandoned Radtke U.S. Ser. No. 220,306, filed Dec. 29, 1980 (which discloses an improved arrangement for securing replaceable nozzles in drilling bits by means of a metal or hard metal retaining ring).

This improved drill bit comprises a tubular body 2 which is adapted to be connected as by a threaded connection 3 to a drill collar 4 in a conventional drill string. The body 2 of drill bit 1 has a passage 5 which terminates in a cavity 6 formed by end wall 7 which is the cutting face of the drill bit. Drill bit 1 has a peripheral stabilizer surface 8 which meets the cutting face 7 at the gage cutting edge portion 9.

The stabilizer portion 8 has a plurality of grooves or courses 10 which provide for flow of drilling mud or other drilling fluid around the bit during drilling operation. The stabilizer surface 8 also has a plurality of cylindrical holes or recesses 11 in which are positioned hard metal inserts 12. These hard metal inserts 12 are preferably of a sintered carbide and are cylindrical in shape and held in place in recesses 11 by an interference fit with the flat end of the insert being substantially flush with the stabilizer surface 8.

Figure 2:
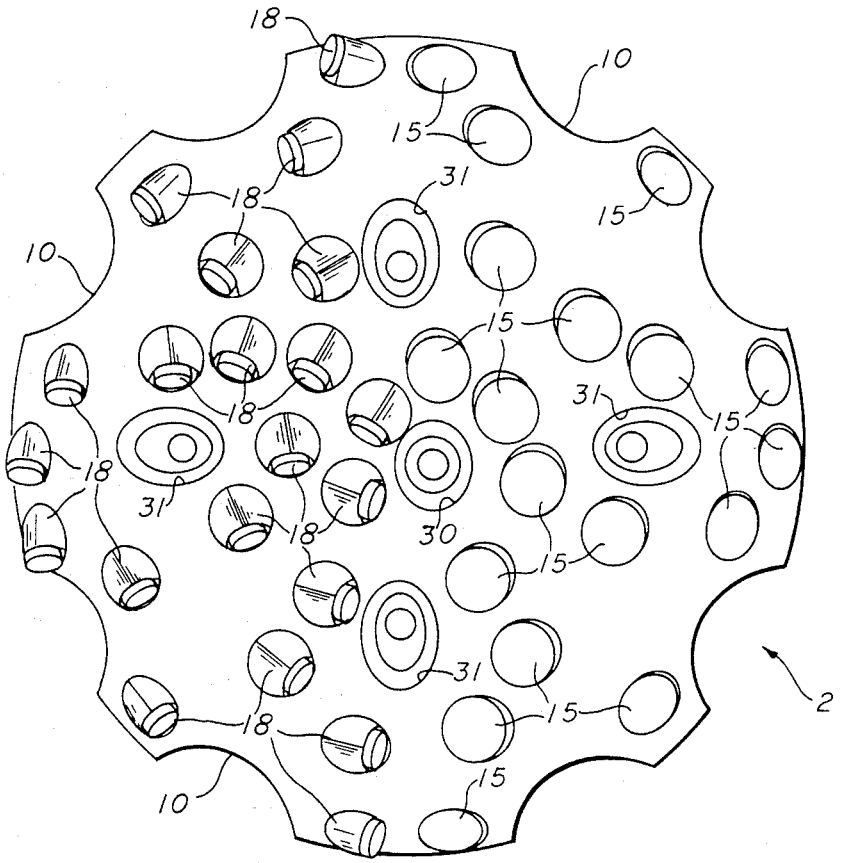
FIG. 2 is a plan view of the bottom of the drill bit shown in FIG. 1 showing half of the bit with cutting inserts in place and half without the inserts, showing only the recesses.

The cutting surface or cutting face 7 of the drill bit body 2 is preferably a crown surface defined by the intersection of outer conical surface 13 and inner negative conical surface 14. Crown surfaces 13 and 14 have a plurality of sockets or recesses 15 spaced in a selected pattern. In FIG. 2, it is seen that the sockets or recesses 15 and the cutting inserts which are positioned therein are arranged in substantially a spiral pattern.

Figure 3:
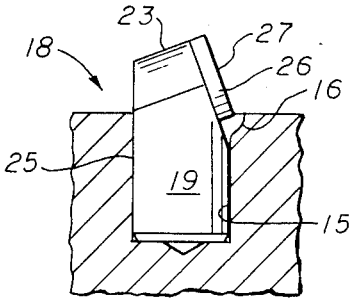
FIG. 3 is a sectional view taken normal to the surface of the drill bit through one of the recesses in which the cutting inserts are positioned and showing the insert in elevation.
Figure 4:
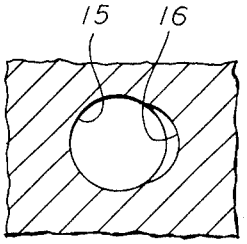
FIG. 4 is a sectional view in plan showing the hole or recess in which the cutting insert is positioned.

In FIGS. 3 and 4, the sockets or recesses 15 are shown in more detail with the cutting inserts being illustrated. Each of the recesses 15 is provided with a milled offset recess 16 extending for only part of the depth of the recess 15. The recesses 15 in crown faces 13 and 14 receive a plurality of cutting elements 18 which are seen in FIGS. 1 and 2 and are shown in substantial detail in FIGS. 3, 5, 6 and 7.

Cutting elements 18 which were previously used were the STRATAPAX cutters manufactured by General Electric Company and described in Daniels, et al. U.S. Pat. No. 4,156,329, Rowley, et al, U.S. Pat. No. 4,073,354 and in considerable detail in ADVANCED DRILLING TECHNIQUES by William C. Maurer. The STRATAPAX cutting elements 18 consist of a cylindrical supporting stud of sintered carbide. The supporting stud is beveled at the bottom, has edge tapered surfaces, a top tapered surface and an angularly oriented supporting surface. A small cylindrical groove is provided along one side of the prior art supporting stud for use with a key for preventing rotation. A disc shaped cutting element is bonded on the angular supporting surface, preferably by brazing or the like. The disc shaped cutting element is a sintered carbide disc having a cutting surface of polycrystalline diamond.

In the past, the cutting element discs have been available in only two sizes. The larger size has a diameter of 0.524 in. and is used for drilling soft, medium and medium-hard formations. The smaller size has a diameter of 0.330 in. and is used for drilling hard and extra hard formations. The smaller size cutting discs are able to cut through hard formations because of the smaller arc of cutting surface which engages the formation being drilled.

The smaller discs, however, have the disadvantage of not being very efficient in drilling through softer formations. The smaller discs have a further disadvantage arising from the fact that greater shear forces are encountered in drilling hard formations and the smaller discs are bonded to the supporting studs in a much smaller surface area. As a result, the smaller discs are more efficient in drilling through hard formations but they are sheared off the supporting studs with a much higher frequency than the larger discs. Consequently, there has been a substantial need for cutting discs which work well in hard formations and in softer formations, and which are not easily lost by shearing off.

In the preferred embodiment (see FIGS. 5–7) of this invention, the carbide studs 19 have the diamond cutting elements 26 brazed thereon, as in the conventional STRATAPAX type cutters. The cutting elements 26, however, are cut into a configuration which provides a short radius arcuate cutting surface for cutting hard formations and has a main body portion of substantially larger radius which provides a larger bonding area for securing the disc to the supporting stud 19. In addition, the transition surface from the short radius cutting surface to the main body portion provides a cutting surface which works well in softer formations. The supporting stud 19 is also cut or formed so that the surface behind the cutting element 26 has a contour which is a continuation of that surface. As will be described below, this contour of the cutting element and the end portion of the supporting stud is effective to resist dulling and breakage of the cutters.

Figure 5:
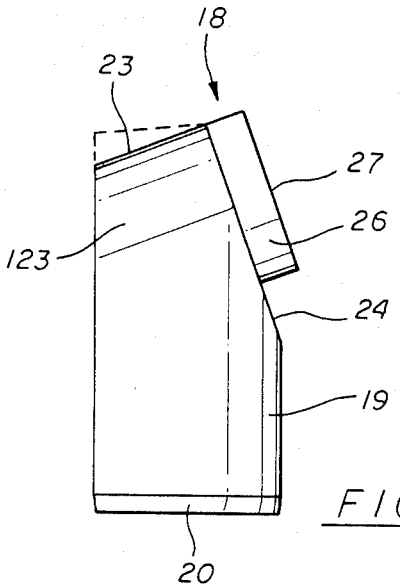
FIG. 5 is a view in side elevation of one of the cutting inserts.
Figure 6:
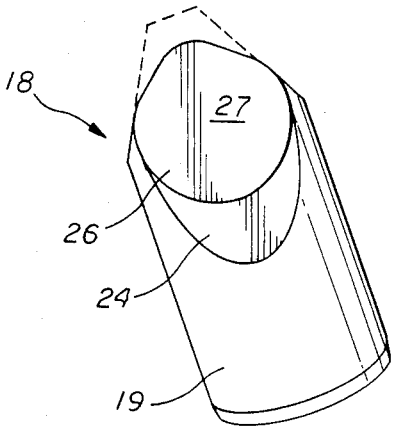
FIG. 6 is a view of one of the cutting inserts in plan relative to the surface on which the cutting element is mounted.
Figure 7:
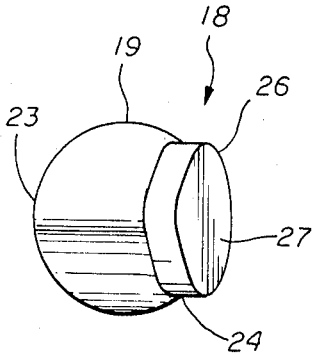
FIG. 7 is a top view of the cutting insert shown in FIG. 5.
Figure 6A:
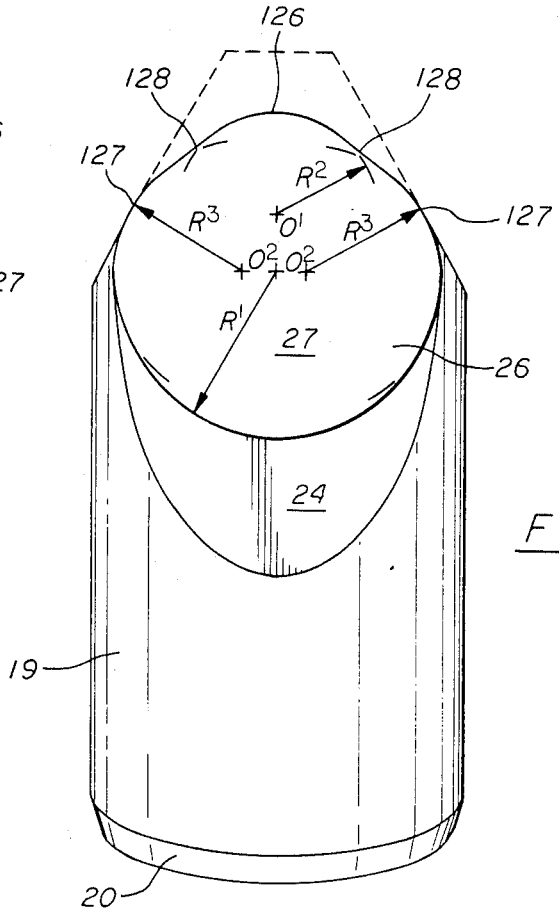
FIG. 6A is an enlarged view of the cutting insert shown in FIG. 6 which shows more detail of the shape of the cutting disc.

FIGS. 5, 6 and 7 show different views of the cutting elements and supporting studs. FIG. 6A is and enlarged view of FIG. 6 which includes certain more or less critical dimensions of the improved cutters. The supporting studs 19 for the cutters are typically 0.626 in. in diameter and 1.040 in. long at the longest dimension. The inclined face 24 is at about 20° relative to the longitudinal axis or to an element of the cylindrical surface of the stud. Side bevels 123 are at about 30° on each side and have a smooth contour which is an extension of the contour of the cutting disc 26. The end relief configuration 23 is at about 20° from a normal intersecting plane and has the same configuration as the cutting end surface of the cutting disc. This cutting element design does not require the edge groove in the supporting stud for an anti-rotation key since the cutter has no tendency to rotate.

The cutting discs have a thickness of about 0.139 in. and a surface layer of polycrystalline diamond at least 0.02 in. thick. The improved cutting discs of this invention may be constructed in the desired shape originally or may be cut to shape from a larger disc. Referring to FIG. 6A, cutting disc 26 is preferably formed from one of the large diameter cutting discs and has a radius $R^1$ of 0.262 in. for the bottom half thereof (the rear half when considered in relation to the cutting function.

The cutting edge 126 has a radius corresponding to the radius of one of the small cutting discs which have been used for drilling hard formations. Cutting edge, in the preferred embodiment, has a radius $R^2$ of 0.165 in. (the same radius as the small cutting discs) from a center offset by a distance $O^1$ of 0.097 in. from the true center of the disc. Intermediate arcs 127 and flat tangential surfaces 128 interconnect cutting surface 126 with the main or uncut portion of the cutting disc. Arcs 127 have radii $R^3$ of 0.203 in. from centers offset by a distance $O^2$ of 0.059 in. from the true center of the disc.

This disc therefore has a lower half or main body portion of large radius (0.262 in.) tapering along arcs 127 and tangential lines to a somewhat pointed end having a cutting edge 126 of small radius (0.165 in.). The various radii given are based on the sizes of cutting discs which are commercially available at the present time. Obviously, other sizes could be used as materials become available for constructing them. The same configuration shown on cutting edge 126, intermediate arcs 127 and flats 128 continues for the supporting stud 19 as seen in FIG. 7. This allows the structure to maintain a sharp cutting edge as the cutter wears.

Supporting studs 19 of cutting elements 18 and the diameter of recesses 15 are sized so that cutting elements 18 will have a tight interference fit in the recesses 15. The recesses 15 are oriented so that when the cutting elements are properly positioned therein the disc shaped diamond faced cutters 26 will be positioned with the cutting surfaces facing the direction of rotation of the drill bit. When the cutting elements 18 are properly positioned in sockets or recesses 15 the cutting elements 26 on supporting stud 19 are aligned with the milled recesses 16 on the edge of socket or recess 15. While the use of recesses or sockets 15 with milled offset recesses 16 is preferred, the cutting elements 18 can be used in any type of recess or socket which will hold them securely in place.

The drill bit body 2 has a centrally located nozzle passage 30 and a plurality of equally spaced nozzle passages 31 toward the outer part of the bit body. Nozzle passages 30 and 31 provide for the flow of drilling fluid, i.e. drilling mud or the like, to keep the bit clear of rock particles and debris as it is operated. The outer nozzle passages 31 are preferably positioned in an outward angle of about 10°–25° relative to the longitudinal axis of the bit body. The central nozzle passage 30 is preferably set at an angle of about 60° relative to the longitudinal axis of the bit body. The outward angle of nozzle passages 31 directs the flow of drilling fluid toward the outside of the bore hole and preferably ejects the drilling fluid at about the peak surface of the crown surface on which the cutting inserts are mounted.

The arrangement of nozzle passages and nozzles provides a superior cleaning action for removal of rock particles and debris from the cutting area when the drill bit is being operated. The particular arrangement of nozzles and the means of securing the nozzles in place is not a part of the claimed invention, but is described to provide a proper setting for the use of the improved cutting elements in a commercially successful drill bit. Nozzle passage 31 comprises a passage extending from drill body cavity 6 with a counterbore cut therein providing a shoulder 43. The counterbore is provided with a peripheral groove in which there is positioned O-ring 35. The counterbore is internally threaded and opens into an enlarged smooth bore portion which opens through the lower end portion or face of the drill bit body. Nozzle member 36 is threadedly secured in the counterbore against shoulder 43 and has a passage 37 providing a nozzle for discharge of drilling fluid. Nozzle member 36 is a removable and interchangeable member which may be removed for servicing or replacement or for interchange with a nozzle of a different size or shape, as desired. The threaded nozzle arrangement is not a part of this invention and is described in more detail in U.S. patent applications Ser. No. 296,811, filed Aug. 27, 1981, Ser. No. 303,721, filed Sept. 21, 1981, and Ser. No. 303,960, filed Sept. 21, 1981.

OPERATION

The operation of this drill bit should be apparent from the foregoing description of its component parts and method of assembly. Nevertheless, it is useful to restate the operating characteristics of this noval drill bit to make its novel features and advantages clear and understandable.

The drill bit as shown in the drawings and described above is primarily a rotary bit of the type having fixed diamond surfaced cutting inserts. Many of the features described relate to the construction of a diamond bit of a type already known. However, these features are used in the bit in which the improved diamond cutter arrangement of this invention is used.

This drill bit is rotated by a drill string through the connection by means of the drill collar 4 shown in FIG. 1. Diamond surfaced cutting elements 18 cut into the rock or other earth formations as the bit is rotated and the rock particles and other debris is continuously flushed by drilling fluid, e.g. drilling mud, which flows through the drill string and the interior passage 5 of the drill bit and is ejected through nozzle passages 30 and 31 as previously described. The central nozzle 30 is set at an angle of about 30° to flush away cuttings and debris from the inside of the cutting down.

The peripheral or stabilizer surface 8 of drill bit body 2 is provided with a plurality of sintered carbide cylindrical inserts 12 positioned in sockets or recesses 11 which protect against excessive wear and assist in keeping the bore hole to proper gage to prevent the drill bit from binding in the hole. The grooves or courses 10 in stabilizer surface 8 provide for circulation of drilling fluid, i.e. drilling mud, past the drill bit body 2 to remove rock cuttings and debris to the surface.

As previously pointed out, the construction and arrangement of the cutting elements and the method of assembly and retention of these elements is especially important to the operation of this drill bit. The drill bit is designed to cut through medium hard rock and is subjected to very substantial stresses. The cutting elements 18 are STRATAPAX type cutting elements (STRATAPAX is the trademark of General Electric Company) modified as described above. Although reference is made to STRATAPAX type cutting elements, equivalent cutting elements made by other manufacturers could be used.

The cutting elements 26, as described above, are cut into a configuration which provides a short radius arcuate cutting surface for cutting hard formations and has a main body portion of substantially larger radius which provides a larger bonding area for securing the disc to the supporting stud 19. In addition, the transition surface from the short radius cutting surface to the main body provides a cutting surface which works well in softer formations.

The supporting studs 19 for the cutters are typically 0.626 in. in diameter and 1.040 in. long at the longest dimension. The inclined face 24 is at about 20° relative to the longitudinal axis or to an element of the cylindrical surface of the stud 19. Side surfaces 123 are a continuation of the surface of the cutting surfaces 126, 127 and 128. The end bevel 23 is at about 20° from a normal intersecting plane and is a continuation of the surface of cutting edge 126.

The cutting discs have a thickness of about 0.139 in. and a surface layer of polycrystalline diamond at least 0.02 in. thick. The improved cutting discs of this invention have a radius $R^1$ of 0.262 in. for the bottom half thereof (the rear half when considered in relation to the cutting function), which is the size of the larger commercially available cutting discs. The cutting edge 126 has a radius corresponding to the radius of one of the small cutting discs which have been used for drilling hard formations, viz. a radius $R^2$ of 0.165 in. This disc therefore has a lower half or main body portion of large radius (0.262 in.) tapering along arcs 127 and tangential lines to a somewhat pointed end having a cutting edge 126 of small radius (0.165 in.). The various radii given are based on the sizes of cutting discs which are commercially available at the present time. Obviously, other sizes can be used as materials become available for constructing them.

When the drill bit is operated under a normal load, the depth of penetration per revolution of the bit is usually no more than 0.0625 in. Under these conditions, only the cutting edge 126 of small radius (0.165 in.) penetrated the formation. The cutting disc has an area of penetration into the formation, at a rate of 0.0625 in. per revolution, of 0.00491 in.$^2$ which is 63% of the penetration area for the larger (0.262 in.) radius discs. These discs, while having a tapered and rounded cutting edge 126 for cutting hard formations, have essentially the full surface area of the larger (0.262 in) radius cutting discs for bonding to the supporting studs 19. As a result of this construction, the cutting discs are substantially less likely to be sheared off in use and also provide the larger tapered cutting surface for making the transition between harder and softer formations. As previously mentioned, the use of a contour in the end of the supporting stud 19 which matches the contour of the cutting disc 26 results is a very substantial reduction in wear of the cutters. In addition, there is reduced deviation and lower torque resulting from lower bit weight requirements.

While this invention has been described fully and completely with special emphasis upon a single preferred embodiment, it should be understood that within the scope of the appended claims the invention may be practiced otherwise than as specifically described herein.

I claim:

1. A drill bit comprising a drill bit body having a hollow tubular body adapted to be connected to a drill string, said drill bit body having an exterior peripheral stabilizer surface and an end cutting face, said end cutting face having a plurality of cylindrical recesses spaced therearound in a selected pattern, a plurality of cutting elements, one for each of said recesses and positioned therein by an interference fit, said cutting elements each comprising a cylindrical supporting stud of sintered carbide having an angularly oriented supporting surface, said supporting surface extending toward a longitudinal axis of said stud from an inner end to an outer end of said surface, a disc-shaped element bonded on said supporting surface comprising a sintered carbide disc having a cutting surface comprising polycrystalline diamond, and each of said disc-shaped elements having a main body portion of a relatively large radius adjacent said inner end of said supporting surface, a somewhat pointed portion having a rounded cutting edge of substantially smaller radius adjacent said outer end of said supporting surface, and a transition portion interconnecting said main body portion and said somewhat pointed portion of smaller radius, whereby the cutting element is effective in hard formation by means of said smaller radius cutting edge and is effective in softer formation by means of said transition portion.

2. A drill bit according to claim 1 in which:

said main body portion comprising about 180° of arc of a larger cutting element disc, said somewhat pointed portion comprising a smaller arc of a radius corresponding to the radius of a smaller disc used for drilling hard formations, and said transition portion comprising intermediate radius and flat tangential surfaces interconnecting said main body portion and said smaller radius cutting edge.

3. A drill bit according to claim 2 in which said cutting disc is brazed on said angularly oriented supporting surface.

4. A cutting element for a drill bit comprising a cylindrical supporting stud of sintered carbide having an angularly oriented supporting surface, said supporting surface extending toward a longitudinal axis of said stud from an inner end to an outer end of said surface, a disc-shaped element bonded on said supporting surface comprising a sintered carbide disc having a cutting surface comprising polycrystalline diamond, and said disc-shaped element having a main body portion of a relatively large radius adjacent said inner end of said supporting surface, a somewhat pointed portion having a rounded cutting edge of substantially smaller radius adjacent said outer end of said supporting surface, and a transition portion interconnecting said main body portion and said somewhat pointed portion of smaller radius, whereby the cutting element is effective in hard formation by means of said smaller radius cutting edge and is effective in softer formation by means of said transition portion.

5. A cutting element according to claim 4 in which said main body portion comprising about 180° of arc of a larger cutting element disc, said somewhat pointed portion comprising a smaller arc of a radius corresponding to the radius of a smaller disc used for drilling hard formations, and said transition portion comprising intermediate radius and flat tangential surfaces interconnecting said main body portion and said smaller radius cutting edge.

6. A disc-shaped cutting element for use in cutting hard surfaces comprising:

a sintered carbide disc having a cutting surface comprising polycrystalline diamond, and said disc having a main body portion of a relatively large radius, a somewhat pointed portion having a rounded cutting edge of substantially smaller radius, and a transition portion interconnecting said main body portion and said somewhat pointed portion of smaller radius, whereby the cutting element is effective in hard formation by means of said smaller radius cutting edge and is effective in softer formation due to said transition portion.

7. A cutting element according to claim 6 in which the tapered portion thereof provides a cutting edge for cutting softer surfaces.

8. A cutting element according to claim 6 in which said main body portion comprising about 180° of arc of a larger cutting element disc, said somewhat pointed portion comprising a smaller arc of a radius corresponding to the radius of a smaller disc used for cutting hard surfaces, and said transition portion comprising intermediate radius and flat tangential surfaces interconnecting said main body portion and said smaller radius cutting edge.

9. A cutting drill bit according to claim 1, wherein the center of said relatively large radius is spaced from the center of said substantially smaller radius by a distance shorter than said relatively large radius.

10. A cutting element according to claim 4, wherein the center of said relatively large radius is spaced from the center of said substantially smaller radius by a distance shorter than said relatively large radius.

11. A cutting element according to claim 6, wherein the center of said relatively large radius is spaced from the center of said substantially smaller radius by a distance shorter than said relatively large radius.

* * * * *